US009208702B2

(12) United States Patent
Iriarte Sanllehi

(10) Patent No.: US 9,208,702 B2
(45) Date of Patent: Dec. 8, 2015

(54) ADVERTISING DEVICE FOR DIVERSE TERRAIN

(75) Inventor: Ignacio Iriarte Sanllehi, Sant Cugat Del Valles (ES)

(73) Assignee: ADNETGOAL, S.L., Barcelona (ES)

( * ) Notice: Subject to any disclaimer, the term of this patent is extended or adjusted under 35 U.S.C. 154(b) by 3 days.

(21) Appl. No.: 14/236,149

(22) PCT Filed: Jul. 30, 2012

(86) PCT No.: PCT/ES2012/070590

§ 371 (c)(1),
(2), (4) Date: Jan. 30, 2014

(87) PCT Pub. No.: WO2013/017722

PCT Pub. Date: Feb. 7, 2013

(65) Prior Publication Data

US 2014/0144054 A1 May 29, 2014

(30) Foreign Application Priority Data

Aug. 1, 2011 (ES) ..... 201130837
Nov. 9, 2011 (ES) ..... 201131158
Apr. 4, 2012 (ES) ..... 201230370

(51) Int. Cl.

| | |
|---|---|
| ***G09F 7/00*** | (2006.01) |
| ***G09F 7/06*** | (2006.01) |
| ***G09F 19/22*** | (2006.01) |
| ***G09F 7/08*** | (2006.01) |

(52) U.S. Cl.
CPC .. *G09F 7/06* (2013.01); *G09F 7/08* (2013.01); *G09F 19/22* (2013.01)

(58) Field of Classification Search
USPC ..... 40/552, 596, 611.06, 618
See application file for complete search history.

(56) References Cited

U.S. PATENT DOCUMENTS

| | | | | |
|---|---|---|---|---|
| 1,869,314 | A * | 7/1932 | Patinot | 40/618 |
| 2,520,648 | A * | 8/1950 | Newman | 40/618 |
| 2,538,056 | A | 1/1951 | Staaf | |
| 2,598,890 | A * | 6/1952 | Cisi et al. | 40/618 |
| 2,630,613 | A | 3/1953 | Smithson et al. | |
| 2,636,300 | A * | 4/1953 | Suckle | 40/618 |
| 4,387,520 | A | 6/1983 | Ahrens | |

FOREIGN PATENT DOCUMENTS

NL 1 036 385 C 7/2010

OTHER PUBLICATIONS

International search report dated Jan. 17, 2013 in corresponding PCT Application No. PCT/ES2012/070590 filed Jul. 30, 2012.

* cited by examiner

*Primary Examiner* — Joanne Silbermann
(74) *Attorney, Agent, or Firm* — RatnerPrestia

(57) ABSTRACT

The invention relates to an advertising device that includes: a base having a lower support surface and a longitudinal channel in the upper part thereof for mounting and attaching an advertising poster, three-dimensional advertising designs made of a flexible shape-memory material, a means of attaching the advertising poster to the base, and a means of attaching the base to the ground.

25 Claims, 10 Drawing Sheets

ADVERTISING DEVICE FOR DIVERSE TERRAIN

CROSS REFERENCE TO RELATED APPLICATIONS

This application is a 371 application of International Application No. PCT/ES12/070590, filed Jul. 30, 2012, which claims priority to Spanish Patent Applications 201130837, filed Aug. 1, 2011, 201131158, filed Nov. 9, 2011 and 201230370, filed Apr. 4, 2012, all of which are incorporated by reference in its entirety herein.

DESCRIPTION

The present invention relates to an advertising device for placing advertising motifs in an essentially vertical position on the ground or terrain of, for example, a sports ground, without posing risk to persons in the proximity thereof and offering high visual impact to observers.

The advertising device is applicable to exhibiting advertisements on diverse terrain, in particular, albeit in a non-limitative manner, on sports fields.

It is common that advertising devices of diverse types are placed in sports fields and places where events having a large public attendance are held, with the objective of taking advantage of the attention of so many people. These advertising devices have greater impact when there is television transmission of a match or event held at the location, for example a football match in a stadium. For this reason advertising devices seek to improve the attractiveness thereof.

From the point of view of advertising impact, the goal area is of great importance. Nevertheless, the placement of traditional devices in said zone is problematic by virtue of the existence of movement of sportspeople, who might be harmed on colliding against the devices. In the case of sports having a goal, the goal net is a location having great advertising impact. However, regulations prohibit the placement of advertising on the net. Nevertheless, it is a desirable objective to achieve advertising devices simulating being on the net and which, simultaneously, do not pose a risk to sportspeople.

Document ES 1073117 describes a device comprising a transparent laminar element, in a vertical or inclined position, provided with supports underneath, also of transparent constitution, for the disposition thereof behind the net of a goal. Upon this laminar element there are opaque or semi-transparent zones, having a colour uniform with or similar to the colour of the said net, for the formation of a design, notice or logo. The device creates the optical effect that the opaque or semi-transparent zones are incorporated into the goal net when observed from several perspectives.

The principal disadvantage of this device is that with rain or high ambient humidity, the transparent laminar element mists up or accumulates water drops, causing a reduction in visual impact and preventing the clear display of the advertisement. Another of the drawbacks of this device is that it may cause injury to persons or players in the case of collision with the same, for which reason the placement thereof on the goalposts would be inappropriate.

In summary, a problem which the present patent seeks to overcome is that of achieving a device permitting placing advertising such that it appears to be placed on the net, without it so being, the device being of such a nature that it is not dangerous for the players should they accidentally collide with the same.

The applicant of the present invention is unaware of the existence of prior art resolving the identified problem in a satisfactory manner.

The present invention comprises an advertising device presenting technical features intended to offer a novel and visually-attractive aspect without posing a risk to the safety of persons in the proximity thereof, principally sportspeople participating in a sporting event at which said device has been mounted.

Said objective is achieved with a device according to claim 1.

The advertising motifs may be formed of letters, words, logos, drawings and/or diverse figures located in an upright disposition on the ground, having an attractive form. The visual effect is of the advertising motifs being located in an essentially vertical manner with respect to the ground or terrain of the sports field, having a three-dimensional volume provided by the thickness thereof. To increase the effect of three-dimensionality or thickness, the zone determining the thickness of the advertising motifs may be provided with a colour differing from that of the front and rear faces thereof. This device is unaffected by humidity or rain prejudicing the display thereof and does not produce reflections of nor gleams from spotlights or the sun which might create difficulty in the appreciation or viewing thereof.

The invention moreover comprises various aspects and embodiments presenting the adaptation of the invention to diverse situations.

According to a first aspect of the invention, the advertising device comprises:

- a support defining a support surface defining upperly a longitudinal housing or channel delimited by two lateral walls presenting transverse orifices;
- advertising motifs of a flexible material having shape memory, presenting a lower zone for attachment in the longitudinal channel of the support, which zone shall be denominated lug; and
- the device may optionally present elements for fixing the advertising motifs mounted through the transverse orifices of the lateral walls of the channel of the support together with orifices formed in the lugs of the advertising motifs.

The support may present vertical orifices for the anchoring thereof to the ground. In this manner the support being knocked over as a consequence of thrust from wind action is prevented.

The lug of the advertising motifs preferably presents a thickness engaging in that of the longitudinal channel of the support wherein it is introduced, meaning that, since introduced into the longitudinal channel, the advertising motifs remain disposed in the same plane, said fixing being ensured by means of the aforementioned transverse fixing elements.

In a preferred embodiment, the flexible material, having shape memory, which is used to produce the advertising motifs is EVA (ethylene vinyl acetate). This material is light and should a sportsperson collide with or push the advertising motifs they yield without causing injury whatsoever. Advertising motifs which have been pushed recover the previous upright position thereof when the thrust force ceases.

The advertising motifs may be produced on the basis of various mutually-independent elements for the aligned placement thereof in the longitudinal channel of the support, or they may form a single body, in this case being joined by means of a common lug, as a consequence of which the mounting thereof in the support is simpler and the fixing thereof within the interior of the channel may be realised with a smaller number of penetrating fixing elements.

In an especially advantageous embodiment, the exterior surface of the support presents a colour which makes it possible to camouflage the support against the background of the place wherein it is located (terrain of the sports field or surface whereon the advertising device is installed). This colour may be achieved through making the support of a material of the colour to camouflage, the painting thereof with the appropriate colour or the covering thereof with an appropriate sheet. For example, a sheet mimicking the grass of a football field such that said support visually merges with the terrain and the spectator solely observes the advertising motifs as if floating above the field.

By means thereof, the dual effect is achieved of camouflaging the support such that solely the advertisement is seen as if it were floating in the air without support on the ground and, furthermore, of creating the impression that the advertisement is placed on the net, which effect shall be denominated mimicry in this patent.

According to a second aspect of the present invention, the advertising device presents technical features intended to improve safety in respect of a person impacting against or coming into contact with the support of the advertising motifs, as well as increasing stability and ease of installation.

According to said second aspect, the advertising device comprises:

- a support having a lower support surface, in the upper part thereof there being a longitudinal channel delimited by two lateral walls presenting transverse orifices;
- three-dimensional advertising motifs of flexible material, presenting a lower lug being housed in the longitudinal housing or channel of the support; and
- fixing elements which pass through the transverse orifices of the lateral walls of the longitudinal channel and the orifices defined in the lug of the advertising motifs.

According to an advantageous embodiment of the present invention the support comprises lower appendages disposed so as to be aligned longitudinally in a centred position of said support for anchoring in the ground.

These lower appendages render possible better holding, and the disposition thereof avoids the placement of anchorages the rigid heads whereof are on exterior parts of the support and might represent a risk of injury to a person impacting against or coming into contact with the device and, more specifically, the support.

To increase safety and prevent injury, the support has been designed to present rounded longitudinal edges, front and rear, the upper part of the vertical walls also being rounded, defining longitudinal rebated spaces wherein are executed the transverse orifices. In this manner, the support lacks projecting angular parts on the exterior contour thereof which might cause damage or cut. Furthermore, the rebated spaces permit placement of the ends of the fixing elements, for example screw heads and nuts, away from zones of direct contact with the body of a person impacting against or coming into contact with said support, protecting said person.

In a further preferred embodiment of the device, the lower appendages are defined in the support itself, extending perpendicularly from the lower surface of said support. As a consequence thereof it is easy to anchor the device in the ground in a direct manner through simply adding weight.

In another embodiment, the longitudinal channel of the support presents apertures in the base thereof being the protected positioning for lower demountable appendages; these appendages, such as screws or the like, present the heads thereof protected within the longitudinal channel beneath the advertising motifs, as a consequence whereof it is not possible for a person to be harmed or injured by any part whatsoever of said demountable lower appendages.

For the purpose of improving the repeated removable disposition of the device in the same location, said device may comprise tubular sleeves for inserting the lower appendages in holes in the ground. These tubular sleeves, of variable length according to the requirements for entry of the lower appendages, prevent said orifices from closing when the device is not installed and render possible the simple and rapid placement of the device, maintaining the stability thereof.

Furthermore, since these advertising materials are made of flexible material, should a player or person collide against the device, the risk of being injured is minimal by virtue of the fact that said advertising motifs yield. When the force on the advertising motifs ceases to be applied, they return to the original position thereof.

According to a third aspect, the present invention also presents preferred embodiments for those cases in which elements in the advertising motif are positioned one above another, such as in the case of accents, hyphens, graphics etc, wherein it is intended to create the effect of the inexistence of connection therebetween.

A possible solution in both cases would be extension towards the lower zone of part of the motifs formed from separate parts or those being higher with respect to those having a lug for the support thereof on the lower support; however, this solution requires varying the original form of the advertising motifs to be displayed, in general being unacceptable. The present invention comprises, in a non-limitative manner, two preferred solutions therefor.

According to said third aspect, the advertising device which is the subject-matter of the invention, being of the type of those aforementioned, presents design features orientated towards ensuring correct subjection of the diverse three-dimensional advertising motifs to the support, maintaining the original forms thereof, and even when part of said advertising motifs form separate or independent parts from the remainder, such as for example in the case of accents, hyphens, or in those cases wherein the greater part of the advertising motifs are elevated with respect to the longitudinal channel of the support, a very small number of the motifs being fixed to said support by means of the respective lugs thereof.

For this purpose, and according to the invention, this advertising device comprises at least one transparent laminar element (which may be rigid, semi-rigid or flexible) fixed to all or to part of the motifs forming the advertising sign to establish the join thereof and such that said transparent element extends lowerly beyond the lower extremity of at least a part of said advertising motifs and comprises an lower portion housed and fixed in the longitudinal channel of support.

This transparent element makes it possible to fix all of the motifs to the support, even when said motifs are separate or independent parts from the remainder, without it being necessary to modify the form or the original position of said advertising motifs.

Moreover, the transparent character of the aforementioned element permits it to be invisible to the observer situated at a certain distance, there being visible solely the three-dimensional motifs forming the advertising to be displayed, conferring thereon the desired effect.

Use of this transparent element is moreover preferable when the number of advertising motifs which reach the support and have a lug for housing in and fixing to the upper longitudinal channel of the aforementioned support is insufficient to realise effective subjection with respect to the support of the assembly of advertising motifs forming the sign.

In a preferred embodiment of the invention, the aforementioned transparent element is formed of a flexible material, having the objective of it being deformable in the case of impact, averting the risk of harm to the person or player impacting against the device.

It is relevant to mention that the fixing between the advertising motifs and the transparent element or elements may be by means of adhesive, of the mechanical type, by means of gripping elements, or any other deemed appropriate for this application, by virtue of the fact that it does not affect the essence of the invention.

Similarly, the fixing of the sheet to the support is preferably realised by means of screws or transverse gripping elements, however use is not discounted of any other appropriate means of joining.

According to a fourth aspect of the present invention, the device comprises zones having camouflage decoration intended to merge with the field whereon the device will be placed. Said zones may comprise bridging pieces for joining the advertising motifs and the support. In this manner, said zones are camouflaged with the background of the terrain such that they are invisible to the observer, in particular to the observer at some distance or who observes them by television.

Preferably, the camouflage confers appropriate colouring on said zones of the material of which it is manufactured, painting them or covering them with a suitable material, for example by means of a vinyl sheet mimicking the grass of a football field.

For clarity, drawings are appended which, in terms of an illustrative and explanatory but non-limitative example, show an embodiment of the advertising device which is the subject-matter of the present invention.

Figure 1:
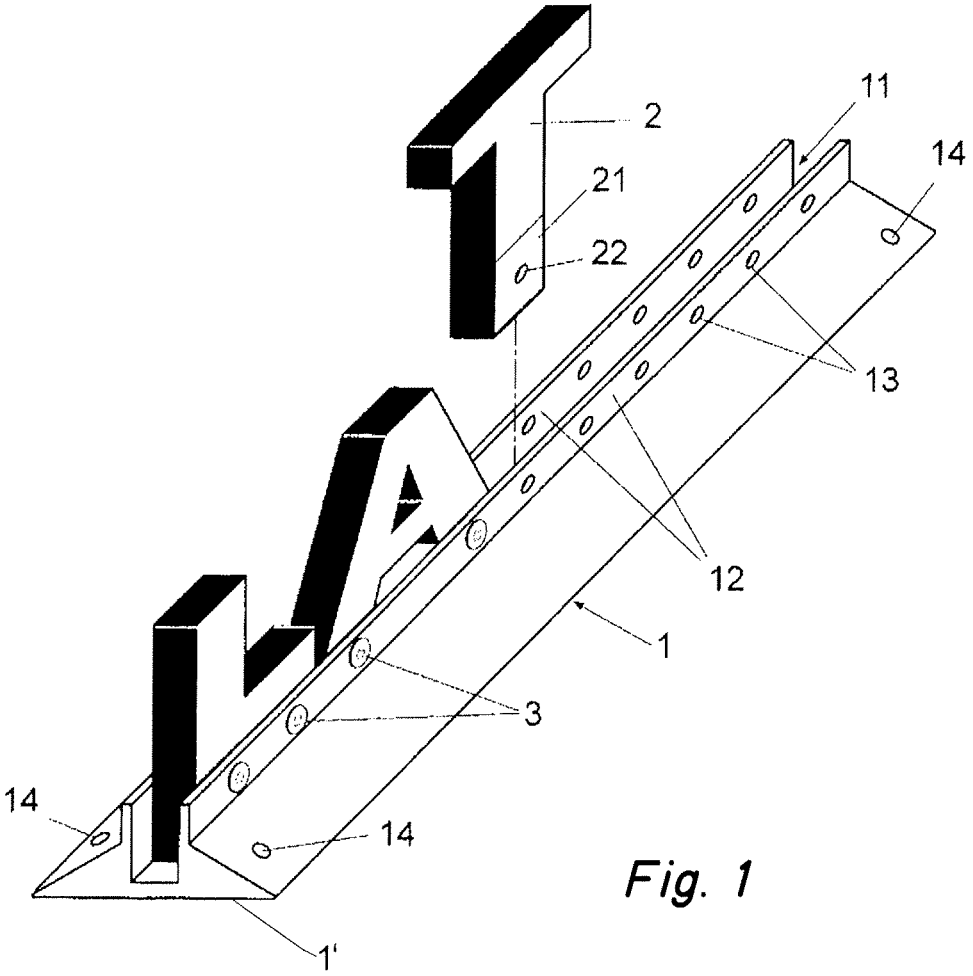
FIG. 1 shows a perspective view of the device with various advertising motifs in place, one being extracted for the observation of the lower lug.

As can be seen in FIGS. 1 to 4, the device comprises a planar support (1) having lower support surface (1') and, upperly, having a longitudinal housing or channel (11) delimited by two lateral walls (12) presenting transverse orifices (13).

In said longitudinal channel (11), three-dimensional advertising motifs (2) are attached which are formed of a flexible material having memory, for example EVA.

Figure 2:
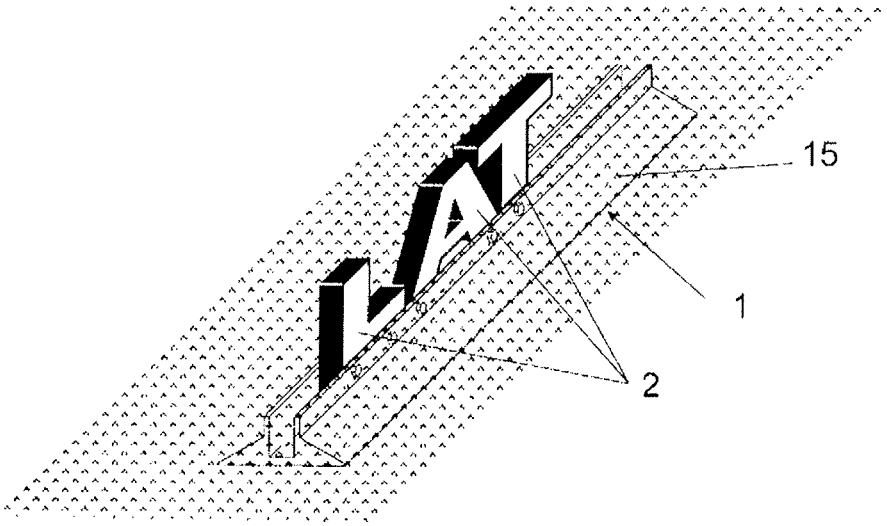
FIG. 2 shows a perspective view of the device put into practice on a sports ground.
Figure 3:
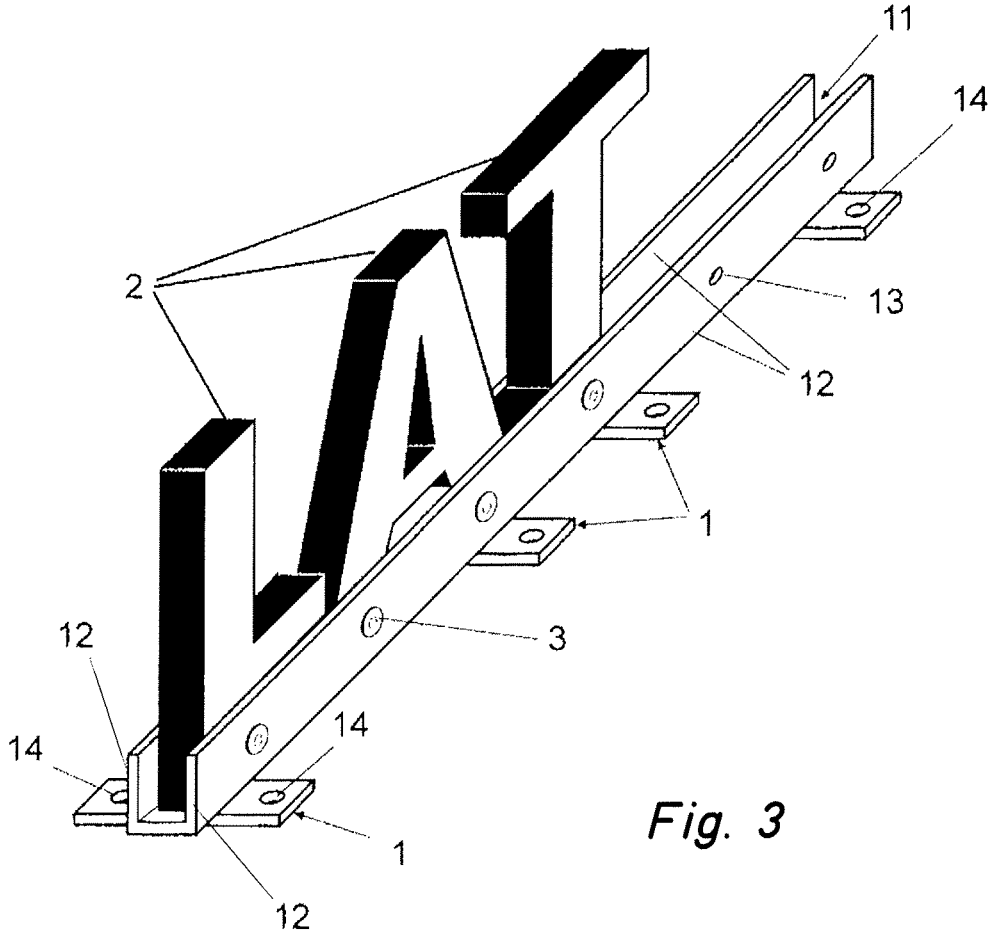
FIG. 3 shows a variant of embodiment of the support formed, in this case, by transverse flat bars fixed beneath the longitudinal channel.
Figure 4:
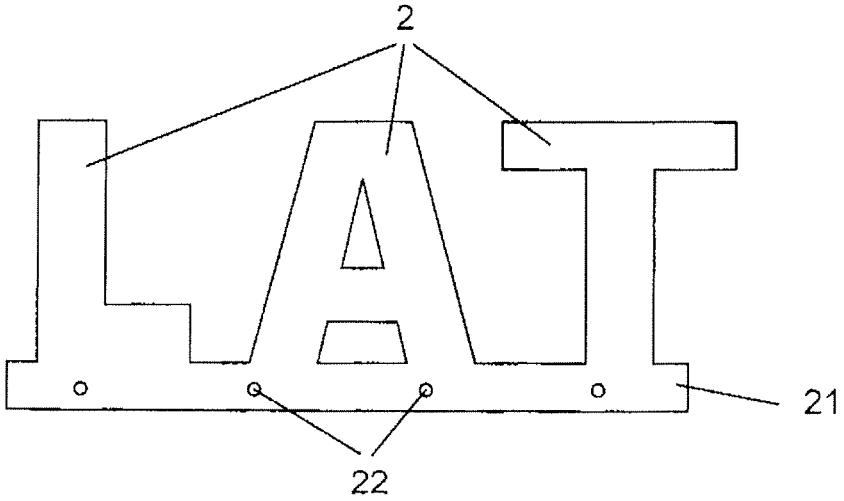
FIG. 4 shows a front elevation of an example of an embodiment of decorative motifs formed in a single body and provided with a common lower lug.
Figure 5:
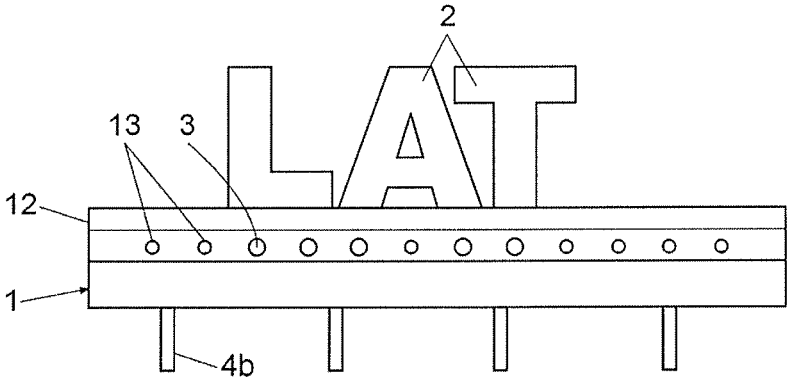
FIG. 5 shows an elevation of an example of another embodiment of the device, according to the invention, wherein are shown the lower appendages.
Figure 6:
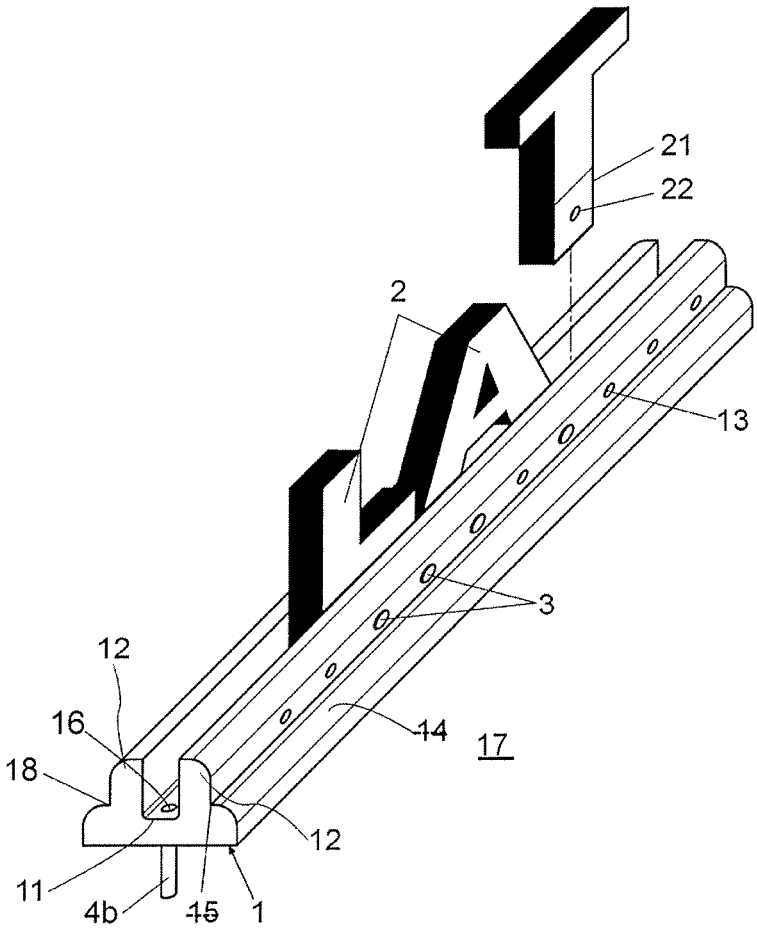
FIG. 6 shows a perspective view of an example of an embodiment of the device wherein the lower appendages are defined in the support itself.

In the example shown in FIGS. 1 to 3, said three-dimensional advertising motifs (2) are independent and have inferiorly respective lugs (21) for the attachment and fixing thereof within the interior of the longitudinal channel (11). In the variant shown in FIG. 4, advertising motifs (2) are formed in a single body and inferiorly have a common lug (21) for the attachment and fixing thereof on the longitudinal channel (11) of the support (1).

The lug or lugs (21) of the advertising motifs (2) present a thickness engaging with the width of the longitudinal channel (11) of the support (1) for the close-fitting placement thereof within the interior thereof, such that said advertising motifs are disposed co-planarly. The device comprises fixing elements (3), in this case screws and nuts, mounted through the transverse orifices (13) of the lateral walls (12) of the support (1), and through the orifices (22) of the lugs (21) of the advertising motifs (2).

It is relevant to mention that support (1) of the longitudinal channel (11) may present diverse geometries; in this manner, for example, in FIGS. 1 and 2 the support presents a planar configuration and defines two continuous surfaces on both sides of the longitudinal channel (11), whilst in the variant of FIG. 3, it is constituted by transverse flat bars fixed beneath the longitudinal channel (11).

In both cases the support (1) has vertical apertures (14) at the sides of the longitudinal channel (11) for mounting elements for anchoring in the ground or terrain, not shown.

The planar support (1) presents on the exterior face thereof a covering sheet (15) for the camouflaging thereof against the terrain whereon it is placed. Instead of carrying said sheet, camouflaging may be achieved, according to the invention, through painting the support or producing it from a material of appropriate colour.

FIGS. 5 to 8 show a second embodiment of the present invention, comprising a support (1) having a lower support surface and superiorly a longitudinal channel (11) for the placement of the three-dimensional advertising motifs, fixable by means of extractable fixing elements (3). Said longitudinal channel (11) is delimited by two lateral walls (12) presenting transverse orifices (13) for the passage of said fixing elements (3).

Figure 7:
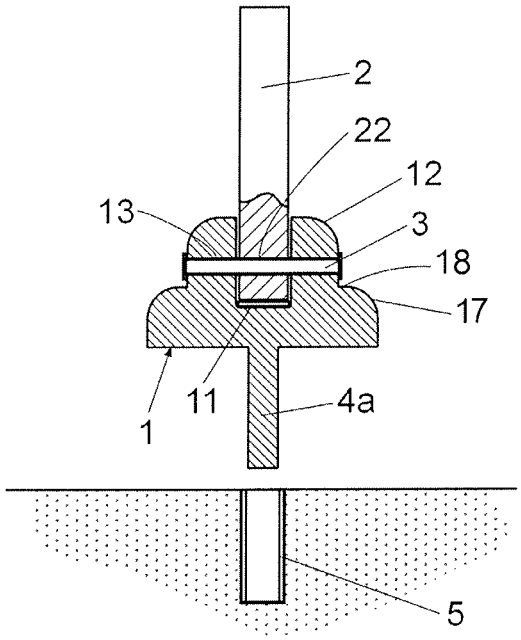
FIG. 7 shows a profile view of a further embodiment of the device, the support of the previous figure being displaced vertically with respect to the ground, wherein the holes in the ground have tubular sleeves for the insertion of the lower appendages.

In the lower part of the support (1), lower appendages (**4*a*) are disposed so as to be aligned longitudinally in a centred position of said support (1). FIG. 7 shows how the lower appendages (4*a*) are constituted in the body itself of the support (1**).

The support (1) has rounded longitudinal edges (17), front and rear. The upper part of the vertical walls (12) is also rounded, defining longitudinal rebated spaces (18) wherein are executed transverse orifices (13) for the protection of the ends of the fixing elements (3), which in this case comprise screw and nut assemblies.

The advertising motifs (2) are formed from a flexible material having shape memory and uniform thickness, in this case EVA. Said three-dimensional advertising motifs (2) are independent and have inferiorly respective lugs (21) for the attachment and fixing thereof within the interior of the longitudinal channel (11).

In this case, the lugs (21) of the advertising motifs (2) present a thickness engaging with the width of the longitudinal channel (11) of the support (1) for the close-fitting placement thereof within the interior thereof, such that said advertising motifs (2) are disposed co-planarly. The lugs (21) present orifices (22) alignable with the transverse orifices (13) of the lateral walls (12) for the passage of the fixing elements (3) which render said advertising motifs (2) integral with the support (1).

In another embodiment, represented in FIG. 7, it may be observed that the device (1) comprises tubular sleeves (5) placed in holes produced in the ground wherein are inserted the lower appendages (4*a*) of the support (1).

Figure 8:
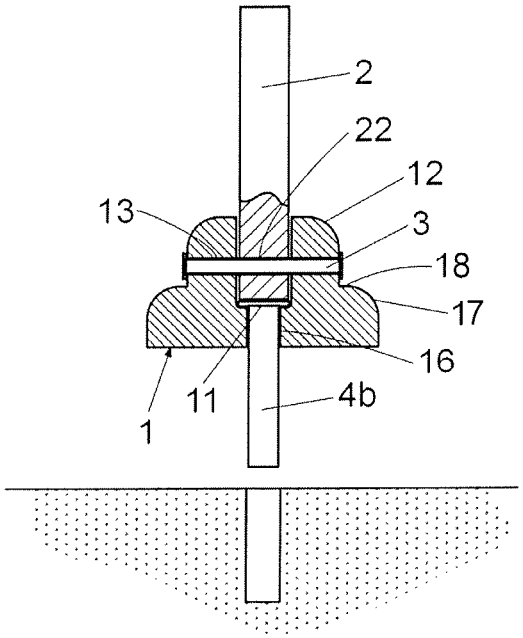
FIG. 8 shows a view analogous to the previous view of yet another embodiment, wherein the lower appendages are constituted of demountable parts housed in orifices defined in the base of the longitudinal channel of the support.
Figure 9:
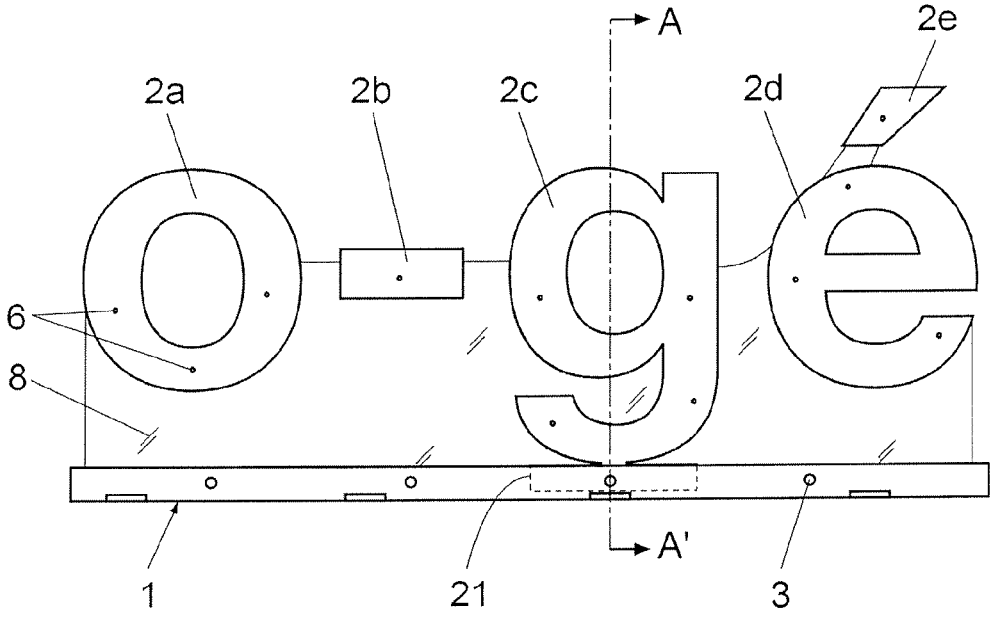
FIG. 9 shows a front elevation of a yet further example of an embodiment of the advertising device which is the subject-matter of the invention.
Figure 10:
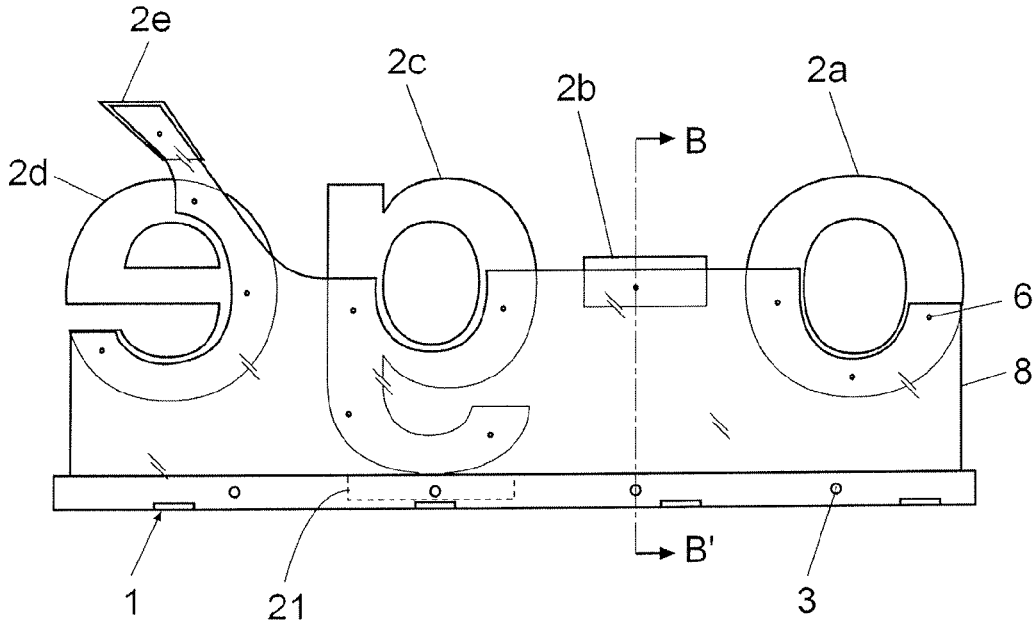
FIG. 10 shows a rear elevation of the advertising device of the previous figure.

In an alternative embodiment, represented in FIG. 8, the longitudinal channel (11) of the support (1) presents in the base thereof protected positioning apertures (16) of the demountable lower appendages (4*b*).

In a further example of an embodiment, shown in FIGS. 9 to 12, there may be observed an advertising device according to the invention, comprising a support (1) having an lower support surface on the ground together with a longitudinal channel (11) in the upper part thereof for the mounting and fixing of an advertising poster bearing advertising motifs (2*a*, 2*b*, 2*c*, 2*d*, 2*e*) formed of separate parts, the device according to the invention comprising a transparent sheet (8), in this case being fixed to all advertising motifs (2*a*, . . . , 2*e*) and establishing the joining thereof.

Figure 11:
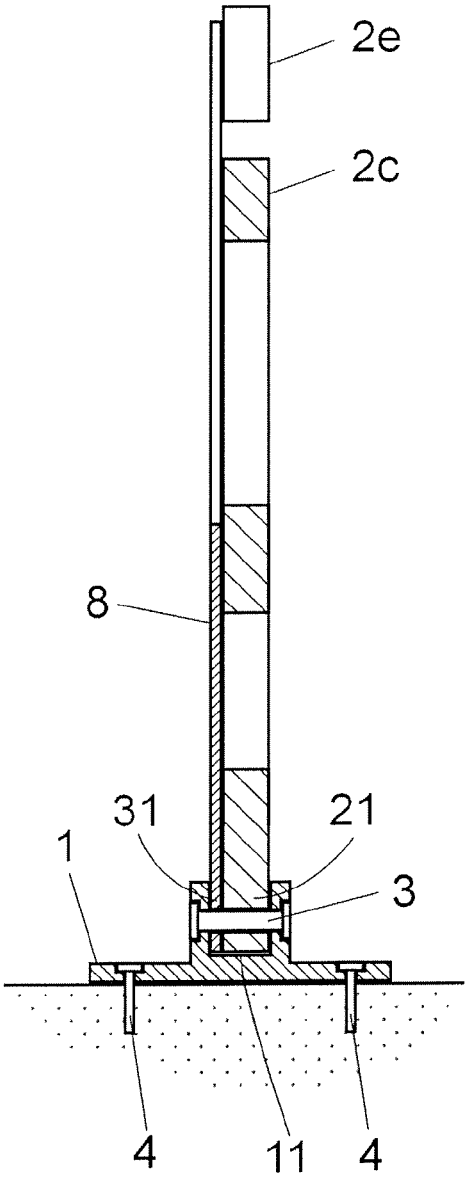
FIG. 11 shows a profile view of the advertising device of FIG. 9 sectioned in the plane A-A', that is to say corresponding to one of the advertising motifs provided with an attached lug and fixed to the lower support.
Figure 12:
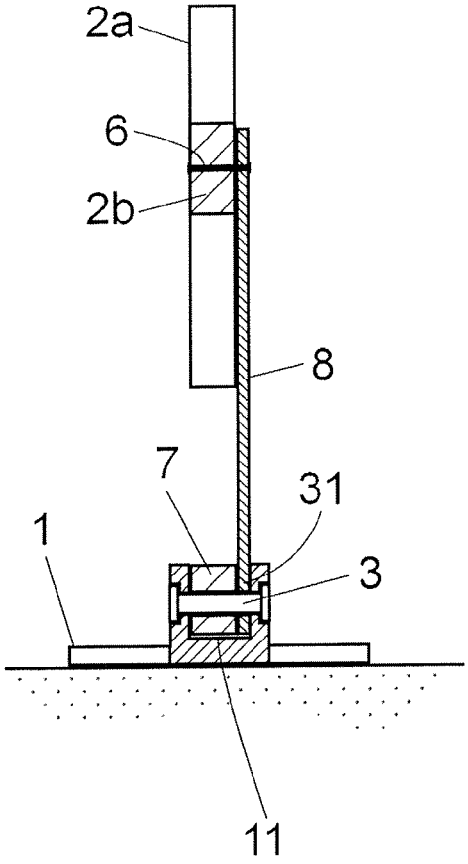
FIG. 12 shows a profile view of the advertising device of FIG. 10 sectioned in the transverse plane B-B' coincident with one of the advertising motifs forming a separate part elevated with respect to the ground support.

Said transparent sheet (8) extends lowerly beyond the extremity of the advertising motifs (2*a*, 2*b*, 2*c*, 2*d*, 2*e*) comprising a lower portion (31) housed and fixed in the longitudinal channel (11) of the support (1), as can be seen in FIGS. 11 and 12.

In the example shown, the transparent sheet (8) ensures stable fixing of diverse advertising motifs (2*a*, . . . , 2*e*) to the support (1) notwithstanding the fact that motifs (2*a*, 2*b*, 2*c*, 2*d*, 2*e*) are distanced vertically with respect to the support (1), solely motif (2*c*) having inferiorly a lug (21) housed and fixed in the longitudinal channel (11) of the support (1), as shown in FIG. 11.

FIG. 12 shows how one of the advertising motifs distanced vertically from the support (1), specifically the advertising motif (2*b*), is maintained fixed in the position thereof to the transparent sheet (8).

The device comprises means (3) for fixing the advertising poster, constituted by the transparent sheet (8) and advertising motifs (2*a*, . . . , 2*e*), to the support (1), in this case said fixing means (3) being represented by transverse gripping screws.

The support (1) moreover has means for fixing to the ground, represented in FIG. 11 by means of screws (4).

It is relevant to mention that the fixing of advertising motifs (2*a*, . . . , 2*e*) may be constituted by an adhesive product or by gripping elements (6).

As can be seen in FIG. 12, in those zones of the longitudinal channel (11) receiving solely the lower portion (31) of the transparent sheet, this latter may be laterally supplemented by a packing part (7) preventing unnecessary lateral play of aforementioned transparent sheet (8).

In FIGS. 13 to 16 a further embodiment of the advertising device which is the subject-matter of the present invention has been represented. In the same, two elements equal or equivalent to elements of the previously-shown embodiments have been identified with identical numbers and, as a consequence, shall not be explained in depth. In this example, an alternative is shown to the installation of a transparent sheet of the previous example which may be more suitable for zones being more accessible by the players or zones wherein highly-directional illumination exists (which would cause the presence of the transparent sheet to be noted).

As has been observed, advertising motifs (2*a*, 2*b*, 2*e*) are mutually joined, when so required, by joining bridging pieces (9*a*, 9*b*, 9*d*). Said joining bridging pieces are integral with advertising motifs (2*a*, 2*b*, 2*e*) and are realised in the same material. To prevent them attracting the attention of the spectator, these bridging pieces are camouflaged by means of covering thereof with sheets (10), for example of vinyl of appropriate colour. These bridging pieces may also be realised in a material mimicking the background whereon the advertising motif is situated. In the case of a device destined for a football field, for example, the camouflage may consist of conferring the colour of the grass on the bridging piece. In the general case, a colour will be selected being confoundable with the colour of the ground whereon the device is placed. Likewise, in the example shown, it has also been camouflaged by means of adhesive sheet (10) on the support (1), contributing to conferring on the advertising motif the sensation of it floating with respect to the ground.

Figure 13:
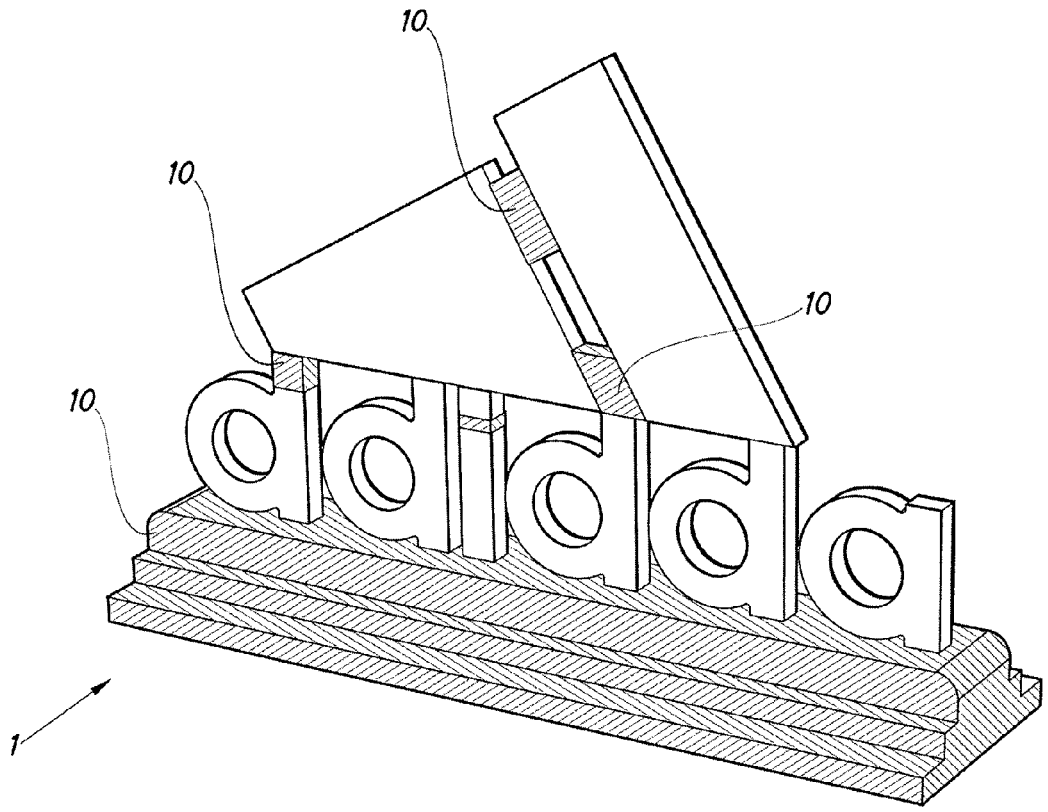
FIG. 13 shows a perspective view of yet another preferred embodiment of the invention.
Figure 14:
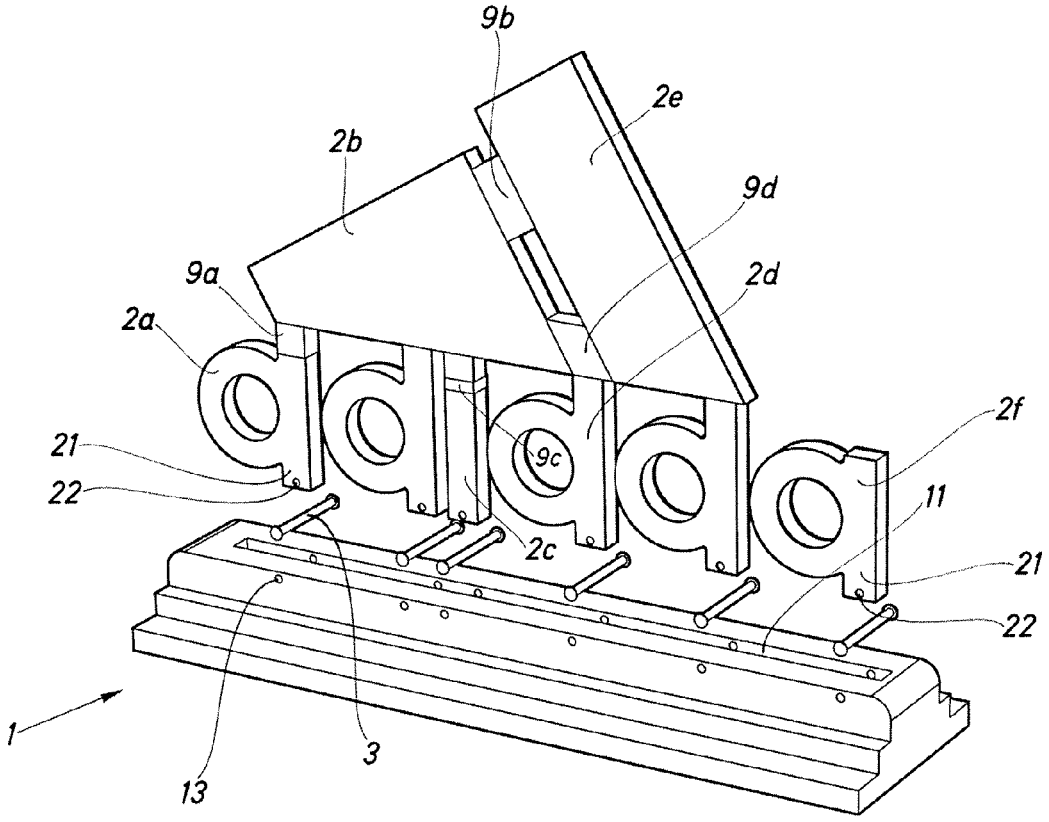
FIG. 14 shows a perspective view of the components of the embodiment of FIG. 13 without the camouflage vinyls.
Figure 15:
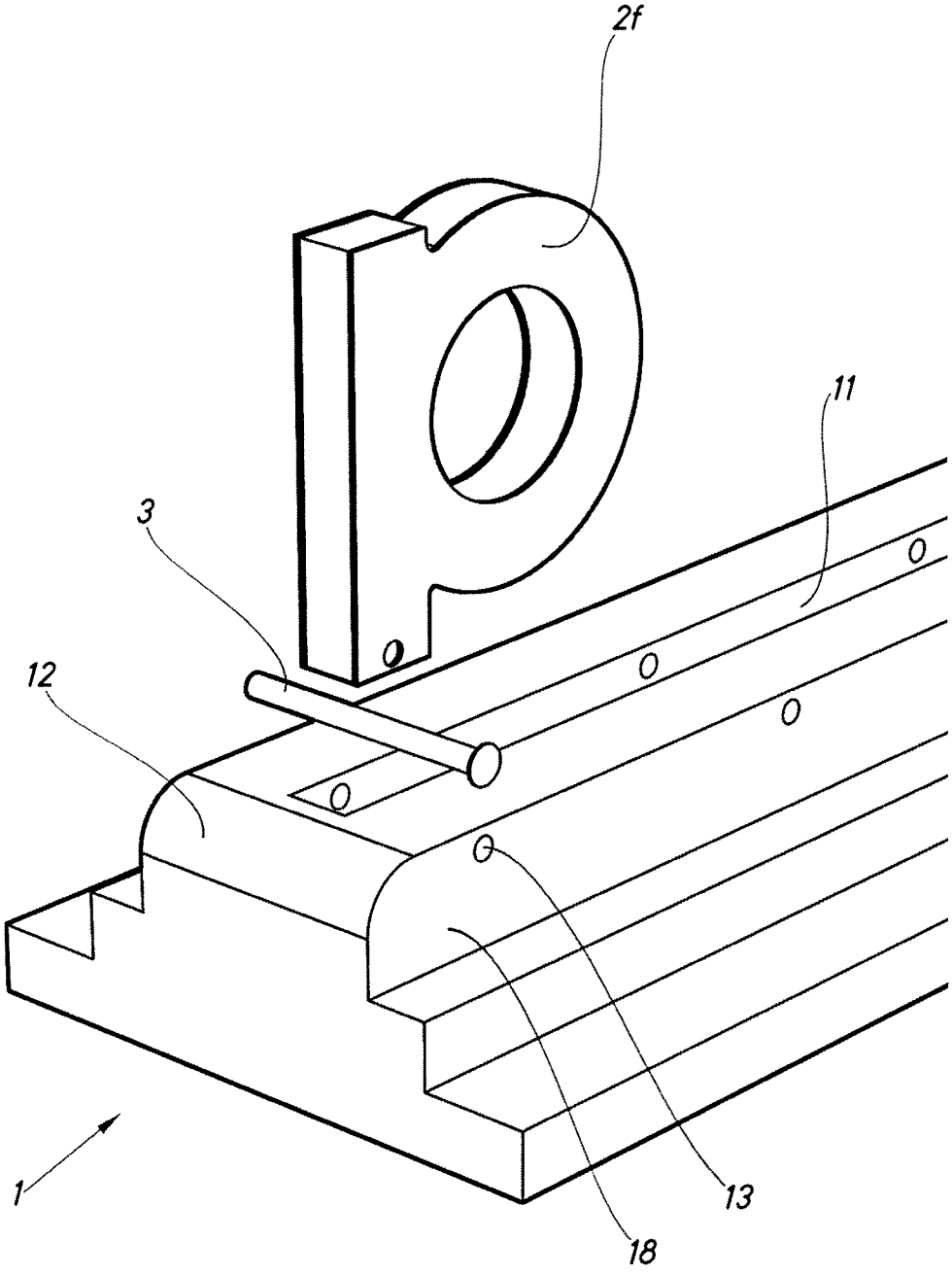
FIG. 15 is a perspective view of a detail of FIG. 14.
Figure 16:
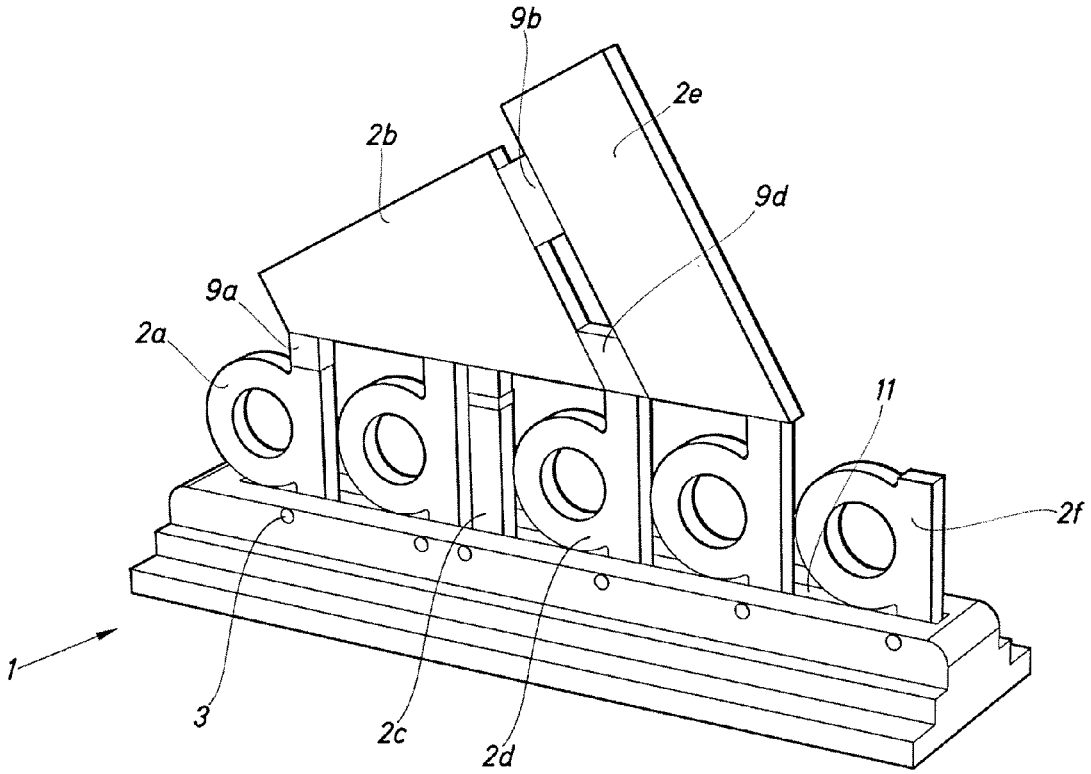
FIG. 16 is a perspective view of the example of an embodiment of FIGS. 13 to 15 prior to placement of the vinyls.

The camouflaged zone of the adhesive element (10) has been represented in FIG. 13 by hatching, however, it shall be understood that the objective thereof is to camouflage from sight the zones covered thereby, consequently it will present a colour similar to that of the environment wherein it is to be placed. In the case of grass fields, the camouflage will consist preferably of a photograph or image of grass.

Having sufficiently described the nature of the invention, together with examples of preferred embodiments, it is placed on record for the due purposes that the materials, form, size and disposition of the elements described may be modified, always provided that this does not signify alteration of the essential characteristics of the invention claimed below.

What is claimed is:

1. An advertising device, comprising:

a support (1) having a lower support surface (1'), a longitudinal housing in the upper part of the lower support surface (1') for fixing of advertising motifs, and an angled or horizontal surface at the side of the longitudinal housing, wherein the angled or horizontal surface has vertical apertures (14) for anchoring the support (1) to ground whereon the support (1) is placed, three-dimensional advertising motifs (2, 2*a*, 2*b*, 2*c*, 2*d*, 2*e*) made of a flexible material having shape memory, means for fixing the advertising motifs to the support (1), and means for fixing the support (1) to the ground.

2. The device according to claim 1, wherein the means for fixing the advertising motifs to the support consist of lower lugs (21), the form of which engages with that of the longitudinal housing provided in the upper zone of the support (1), inserted into said longitudinal housing.

3. The device according to claim 2, wherein lower appendages of the advertising motifs present the shape of a lug and in that the longitudinal housing of the support (1) adopts the form of a longitudinal channel, therein being disposed transverse orifices situated in lateral walls (12) delimiting the longitudinal channel of the support, together with fixing elements (3) mounted through the transverse orifices (13) of the lateral walls (12) of the longitudinal channel, and through orifices (22) defined in the lug of the advertising motifs.

4. The device according to claim 1, wherein the lug (21) of the advertising motifs (2) presents a thickness which is dimensioned so as to engage with the width of the longitudinal channel (11) of the planar support (1).

5. The device according to claim 1, wherein the flexible material, having shape memory, with which the advertising motifs (2) are produced is EVA (ethylene vinyl acetate).

6. The device according to claim 1, wherein the support (1) presents a camouflaged finish or decoration intended to merge with the terrain whereon it is situated, providing the same with the colour of said terrain.

7. The device according to claim 6, wherein said camouflage decoration of the support (1) is executed by manufacturing the material of the support so as to have a colour similar to that of the terrain whereon it is located.

8. The device according to claim 6, wherein said camouflage decoration of the support (1) is executed by painting the support in a colour similar to that of the terrain whereon it is located.

9. The device according to claim 6, wherein said camouflage decoration of the support (1) is executed by covering the support with a sheet having a colour similar to that of the terrain whereon it is located.

10. The device according to claim 1, wherein the longitudinal housing is delimited by two lateral (12) presenting transverse orifices (13);

the three-dimensional advertising motifs are of uniform thickness, presenting a lower lug (21) for attachment in the longitudinal channel (11) of the support (1); and fixing elements (3) mounted through the transverse orifices (13) of the lateral walls (12) and through the orifices (22) defined in the lug (21) of the advertising motifs (2), characterised in that the support (1) comprises lower appendages (4*a*, 4*b*) disposed so as to be aligned longitudinally in a centred position of said support (1) for anchoring in the ground.

11. The device according to claim 10, wherein the support (1) presents rounded longitudinal edges (17), front and rear, the upper part of the lateral walls (12) also being rounded, defining longitudinal rebated spaces (18) wherein are executed the transverse orifices (13).

12. The device according to claim 10, wherein the lower appendages (4*a*) are defined in the support (1) itself, extending perpendicularly from the lower surface of said support (1).

13. The device according to claim 10, wherein the longitudinal channel (11) of the support (1) presents apertures (16) in the base thereof being protected positioning for lower demountable appendages (4*b*).

14. The device according to claim 10, wherein it comprises tubular sleeves (5) for insertion of the lower appendages (4*a*, 4*b*) into holes in the ground.

15. The device according to claim 10, wherein a part of the advertising motifs (2*a*, . . . , 2*e*) presents a lower lug (21) housed and fixed in the longitudinal channel (11) of the support (1).

16. The device according to claim 1, comprising at least a transparent element (3) fixed to all or to part of the advertising motifs (2*a*, . . . , 2*e*), establishing the joining thereof, and in that said transparent element (3) projects lowerly beyond the lower extremity of at least a part of said advertising motifs (2*a*, . . . , 2*e*) and a lower portion (31) housed and fixed in the longitudinal housing of the support (1).

17. The device according to claim 16, wherein the transparent element (8) is formed of a rigid material.

18. The device according to claim 16, wherein the transparent element (8) is formed of a semi-rigid material.

19. The device according to claim 16, wherein the transparent element (8) is formed of a flexible material.

20. The device according to claim 1, comprising joining zones which are located between the advertising motifs having camouflage decoration intended to merge with the field whereon the device will be placed.

21. The device according to claim 20, wherein said camouflage decoration of the joining zones is executed by manufacturing the material of said zones so as to have a colour similar to that of the terrain whereon the device is located.

22. The device according to claim 20, wherein said camouflage decoration of the joining zones is executed by painting said joining zones in a colour similar to that of the terrain whereon the device is located.

23. The device according to claim 20, wherein said camouflage decoration of the joining zones is executed by covering said joining zones with a sheet having a colour similar to that of the terrain whereon the device is located.

24. The device according to claim 23, wherein the covering of the joining zones is executed by means of a vinyl sheet.

25. The device according to claim 20, wherein the camouflage is executed having a colour simulating grass.

* * * * *